US006793217B2

(12) United States Patent
Grønbjerg

(10) Patent No.: US 6,793,217 B2
(45) Date of Patent: Sep. 21, 2004

(54) STACKER FOR DIE-CUT PRODUCTS

(76) Inventor: Ib Grønbjerg, Vingetoften 24, Herlev (DK), 2730

( * ) Notice: Subject to any disclaimer, the term of this patent is extended or adjusted under 35 U.S.C. 154(b) by 0 days.

(21) Appl. No.: 10/408,817

(22) Filed: Apr. 8, 2003

(65) Prior Publication Data

US 2003/0164587 A1 Sep. 4, 2003

Related U.S. Application Data

(63) Continuation of application No. PCT/DK01/00624, filed on Sep. 28, 2001.

(30) Foreign Application Priority Data

Oct. 10, 2000 (DK) ..... 2000 01509

(51) Int. Cl.[7] ..... B65H 29/32

(52) U.S. Cl. ..... 271/197; 271/196; 271/194; 271/209

(58) Field of Search ..... 271/194, 309, 271/196, 310, 207, 184, 209; 83/84–97

(56) References Cited

U.S. PATENT DOCUMENTS

| | | | | |
|---|---|---|---|---|
| 3,708,058 A | | 1/1973 | Kalvern | 198/184 |
| 4,157,177 A | * | 6/1979 | Strecker | 271/197 |
| 4,433,599 A | | 2/1984 | Mundus et al. | 83/87 |
| 4,433,774 A | * | 2/1984 | Lopes | 83/94 |
| 4,627,608 A | | 12/1986 | Harms | 271/197 |
| 5,201,513 A | | 4/1993 | Mion | 271/180 |
| 5,522,693 A | | 6/1996 | Scheucher et al. | 414/793 |
| 5,724,874 A | * | 3/1998 | Lindee et al. | 83/27 |
| 6,234,053 B1 | * | 5/2001 | Olsen et al. | 83/88 |

FOREIGN PATENT DOCUMENTS

| | | |
|---|---|---|
| DE | 2343678 A | 3/1975 |
| DE | 2908901 A | 9/1980 |
| DE | 256306 A | 5/1988 |
| DE | 295 15 857 | 10/1995 |
| DE | 19817064 | 5/1999 |
| EP | 0050860 | 10/1981 |
| EP | 0 526 809 A1 | 2/1993 |
| EP | 0745546 A2 | 12/1996 |
| EP | 0074044 | 3/1998 |
| EP | 827918 | 3/1998 |
| EP | 1 000 879 A1 | 5/2000 |
| FR | 2478047 | 9/1981 |
| GB | 1509 829 | 5/1978 |
| GB | 2 030 969 A | 5/1978 |

* cited by examiner

*Primary Examiner*—Donald P. Walsh
*Assistant Examiner*—Kaitlin Joerger
(74) *Attorney, Agent, or Firm*—Winston & Strawn LLP

(57) ABSTRACT

A stacker for stacking labels die-cut from a continuous web by a die cutter into vertical stacks. The stacker is of the kind that includes at least one stacking chute having an upper opening and a number of mainly vertically arranged walls, at least one overlying belt conveyor having a conveyor belt designed with a number of suction holes distributed along the belt and having a lower run with a direction of conveyance running from the die cutter to the stacking chute, and a suction box located above the lower run and connected to a vacuum source communicating with the suction holes of the lower run via the suction box in an area around the die cutter but not in an area around the stacking chute. A channel for receiving the lower run of the conveyor belt or a lower part of this run is designed in at least a front wall of the walls of the stacking chute, seen in the direction of conveyance, said channel is extending in this direction. The stacker has a simple structure and is able to stack products at the same rate as a rotary die cutter can die-cut the products. Thereby, it is possible to utilize the capacity of the rotary die cutter completely.

20 Claims, 4 Drawing Sheets

Example of values for a conveyer belt of 2100 mm length

| r | n | a | l interval | $v_t$ interval |
|---|---|---|---|---|
| 1 | 4 | 525 | 15 - 17 | 138 – 122 |
| 2 | 5 | 420 | 12 - 15 | 138 – 110 |
| 3 | 6 | 350 | 9 4/8 - 12 | 145 – 115 |
| 4 | 8 | 262.5 | 7 4/8 - 9 4/8 | 138 – 109 |
| 5 | 10 | 210 | 6 1/8 - 7 4/8 | 135 – 110 |
| 6 | 12 | 175 | 4 6/8 - 6 1/8 | 145 – 112 |
| 7 | 15 | 140 | 3 4/8 - 4 6/8 | 157 – 116 |
| 8 | 20 | 105 | 2 2/8 - 3 4/8 | 184 – 118 |
| 9 | 30 | 70 | 1 4/8 - 2 2/8 | 184 – 122 |

r = rownumber of hole
n = number of suction holes in the conveyer belt
a = distance between suction holes (mm)
l = length of the labels (inches)
$v_t$ = transportation speed as a percentage of the production speed

Fig.8

STACKER FOR DIE-CUT PRODUCTS

CROSS-REFERENCE TO RELATED APPLICATION

This application is a continuation of the US national phase of International Application PCT/DK01/00624 filed Sep. 28, 2001, the entire content of which is expressly incorporated herein by reference thereto.

BACKGROUND ART

The invention relates to a stacker for stacking products that are die-cut from a continuous web by a die cutter into vertical stacks. The stacker is of the kind that comprises at least one stacking chute having an upper opening and a number of mainly vertically arranged walls, at least one overlying belt conveyor having a conveyor belt designed with a number of suction holes distributed along the belt and having a lower run with a direction of conveyance running from the die cutter to the stacking chute, and a suction box located above the lower run and connected to a vacuum source communicating with the suction holes of the lower run via the suction box in an area around the die cutter but not in an area around the stacking chute.

Such products can e.g. be labels which are affixed in a labelling plant with magazine. During operation, the magazine is refilled with labels supplied by the labels manufacturers in handy heights.

In some cases, the labels are die-cut from a plurality of sheets having the same height as the desired stack. For this purpose a tubular die cutter is employed. However, this method of die-cutting has the effect of the labels in the same stack not being completely uniform and the die cutter furthermore leaves the labels with a rather irregular edge.

Instead, rotary die cutters have been widely used for die-cutting labels. In a rotary die cutter, a web of labels are continuously conveyed between two counter-rotating rollers. One of the rollers is a plain impression roller and the other is a die-cutting roller having cutting edges for die-cutting the labels.

By means of this method, very high production rates are obtained, and the die-cut labels are furthermore uniform and have a regular and sharp edge. In many cases, the die-cutting roller is designed with a cutting edge for being able to parallel die-cut several labels at the same time.

The web of labels is often made of a dielectric material which is easily charged with static electricity during conveying. The same is the case for the die-cut labels which are normally conveyed on to a stacking station by means of one or several conveyor belts during which the labels are sliding on the belt and/or each other.

The statically charged labels are inclined to stick to e.g., the rolls or frame of the rotary die cutter, and they repel or attract each other in such a way that they are difficult or often impossible to place in an orderly and accurate stack.

Therefore, methods have been developed for discharging the labels by means of e.g., ionized air, brushes or carbon bars. However, these methods are difficult to work with and furthermore require that the labels are conveyed at a relatively low rate, the result of which is that the capacity of the rotary die cutter is far from being utilized to a satisfactory extent.

Thus, there is a need for improvements in such devices.

SUMMARY OF THE INVENTION

With a view towards solving the problems mentioned above, the present invention now provides a stacker which has a simple structure and which is able to stack products successively die-cut from a continuous web at higher rates than hitherto known.

The stacker generally comprises at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, and a suction box located above the lower run and connected to a vacuum source communicating with the suction holes of the lower run of the belt via the suction box in an area around the die cutter but not in an area around the stacking chute.

In one embodiment of the invention, novel and unique features are achieved by the addition of a channel for receiving all or a lower part of the lower run of the conveyor belt. This channel is provided in at least a front wall of the walls of the stacking chute. A product, such as a label or other sheet material, which is conveyed through the front channel is thereby bent in such a way that its diameter is reduced whereby the product is allowed to fall into the stacking chute without hindrance. When the front channel continues into a corresponding channel in the back wall, the latter wall will function as stop to effectively position the labels in the stacking chute.

The products are safely caught in the stacking chute when the walls have a top face inclining downwards from the back to the front wall and continuing into an inclined inlet face extending down under the lower run of the conveyor belt. Thus, the stacking chute walls provide a top opening for the chute that inclines downwardly from the back wall to the front wall, with the top opening continuing into an inclined inlet face or shelf that extends beneath the lower run of the conveyor belt. During the fall down through the stacking chute, the products will meet flow resistance from the air under the products. To reduce this resistance as much as possible, apertures can be provided in the walls of the stacking chute, through which air can exit.

During conveyance from the die cutter to the stacking chute, the products are hanging on the underside of the lower run of the belt conveyor without thereby contacting each other or slide along the conveyor belt. In this way the possibility of the products unintentionally being charged with static electricity is eliminated. The products can therefore be stacked at high rates in orderly and accurate stacks in the stacking chute.

Conventionally, the products made of a dielectric material which discharges the static electricity with which they are charged during conveyance in the plant. However, this process reduces the rate by which it is possible to stack the labels.

According to another feature of the invention, the invention the products can be charged electrostatically prior to and/or during stacking in such a way that the opposite sides of each product will obtain different polarities, and that the sides having the same polarity are facing in the same direction on all products.

The static electricity is now utilized for increasing the stacking rate by positively getting the products to attract each other during stacking. Another advantage is that the complete stack is bound closely and firmly by the electrostatic forces acting between the stacked products.

To avoid that the products are charged with static electricity owing to the fact that they rub against each other during conveyance from the die cutter to the stacking chute, the rate of advance of the conveyor belt can be higher than the production rate of the die cutter whereas the spacing between two adjacent suction holes or set of suction holes in the conveyor belt can be greater than the extent of the products in the direction of conveyance of the belt conveyor.

When a suction shoe is designed around each of the suction holes of the conveyor belt and is extending out from the rest of the belt, the products are kept at a distance from this belt and are thereby ensured against unintentional charging with static electricity due to contact with the belt. In some cases, it is sufficient with one suction hole for each product. In other cases, it would be an advantage to have two or more suction holes for each product. Thereby the products are better and more safely controlled during conveyance.

Preferably, the conveyor belt conveys the products at a higher rate than the production rate of the die cutter. Thereby, the products are kept apart from each other during conveyance. However, it will be an advantage if the products are kept at the same mutual spacing even though the production rate of the die cutter is increased or reduced. For this purpose, the stacker can have a servo-control for controlling the rate of the belt conveyor at a fixed relation in dependence on the production rate of the die cutter.

The invention also relates to a method for stacking labels which comprises bending the labels before they enter the stacking chute to assist in stacking the labels in the chute. The channel conveniently bends the labels as the lower part of the conveyor moves them past the front wall of the stacking chute.

BRIEF DESCRIPTION OF THE DRAWINGS

The invention will be explained in greater detail below, describing only exemplary embodiments with reference to the drawing, in which FIG. 8 is a diagram showing related values of the spacing between suction holes in a conveyor belt for the plant in FIGS. 1–7, the rate of conveyance of this conveyor belt and the length of the die-cut products.

DETAILED DESCRIPTION OF PREFERRED EMBODIMENTS

In the following, the invention is described on the basis of it being e.g. labels that have to be die-cut and stacked.

Figures 1, 2, 3:
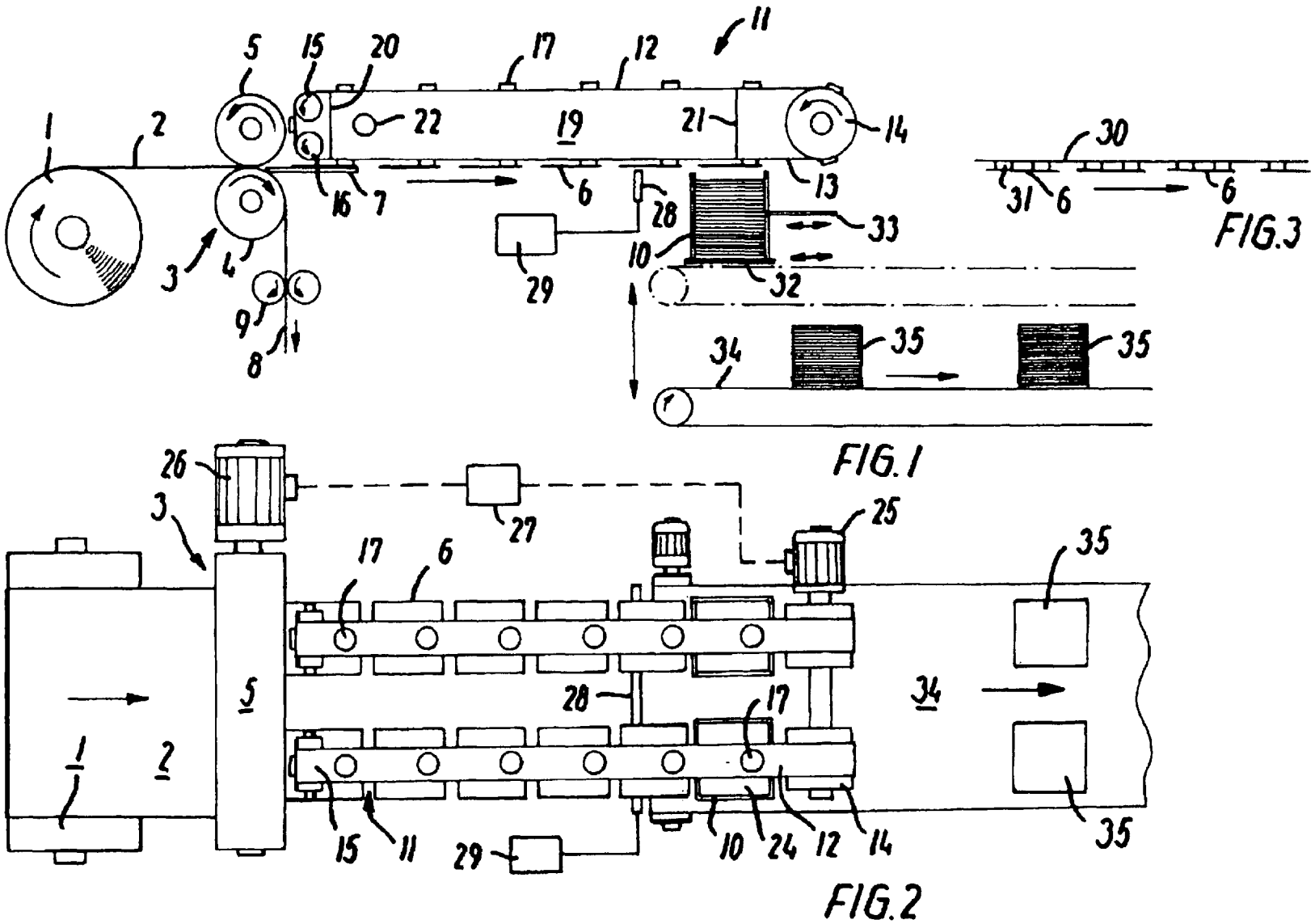
FIG. 1 is a diagrammatic side elevational view of a plant for die-cutting products from a continuous product web and comprising a stacker according to the invention with a conveyor belt and a stacking chute.
FIG. 2 is a plan view of the plant in FIG. 1.
FIG. 3 is a fractional view of a variant of the conveyor belt in FIGS. 1 and 2.

The plant in FIGS. 1 and 2 has a rotatably mounted supply roll 1 with a continuous label web 2 which is conveyed through a rotary die cutter 3 with a plain impression roller 4 and an opposite die-cutting roller 5 provided with a cutting edge (not shown) in a pattern adapted for die-cutting of labels with a corresponding contour.

The label web can be made of any kind of suitable material but in the following it is assumed that the material is a dielectric material so that the die-cut labels are easily charged with static electricity.

When the cutting edges on the roller 5 of the rotary die cutter 3 pass the impression roller 4 at close range, the labels 6 are successively die-cut from the continuous label web 2. The labels can have any desired shape but are shown here having a simple, rectangular contour.

The die-cut labels 6 are pushed out onto a doctor blade 7 in form of a firm base whereas the rest 8 of the label web or the die-cut scraps are carried away from the rotary die cutter by means of, in this case, two counter-rotating scrap rollers 9.

Rotary die cutters are often provided with cutting edges for simultaneous parallel die-cutting of several labels at the same time. In the example shown, it is a rotary die cutter with cutting edges for two labels arranged side by side.

For each of these labels, there is a stacking chute 10 and an overlying belt conveyor 11 for conveying the respective label from the doctor blade 7 to the stacking chute 10.

The belt conveyor 11 comprises an endless conveyor belt 12 with a lower run 13. During operation, the conveyor belt 12 is running about a driving pulley 14 and two idler pulleys 15 and 16. Under this the lower run 13 of the conveyor belt 12 is running, as indicated with the arrow, preferably horizontally from an area close above the doctor blade 7 to over the stacking chute 10.

Figure 4:
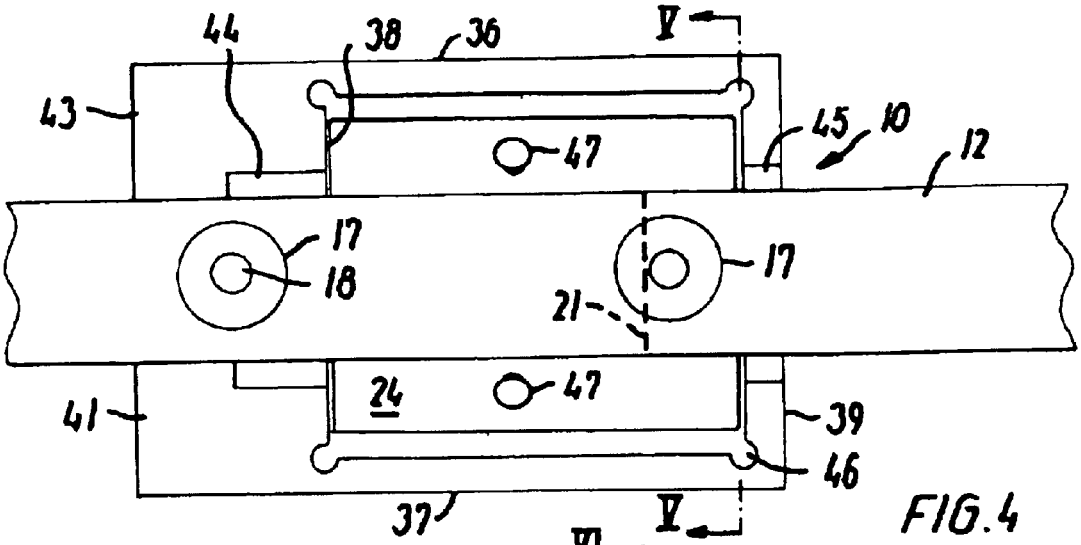
FIG. 4 is on a larger scale a plan view of a fraction of the stacker in FIGS. 1 and 2.
Figure 5:
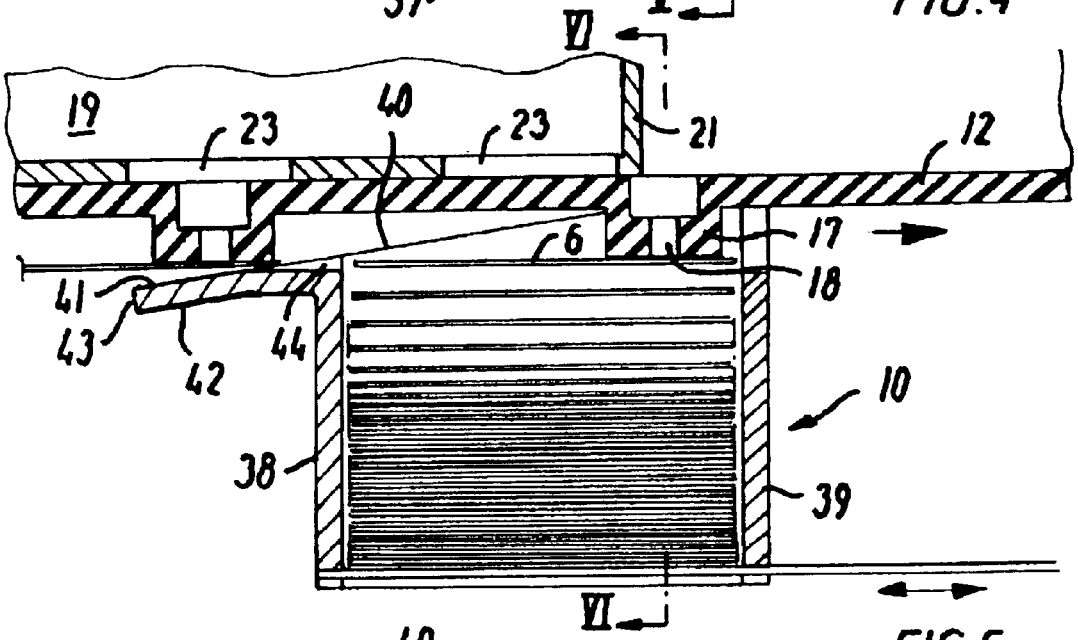
FIG. 5 is a side elevational view taken along the line V—V of FIG. 4.
Figure 6:
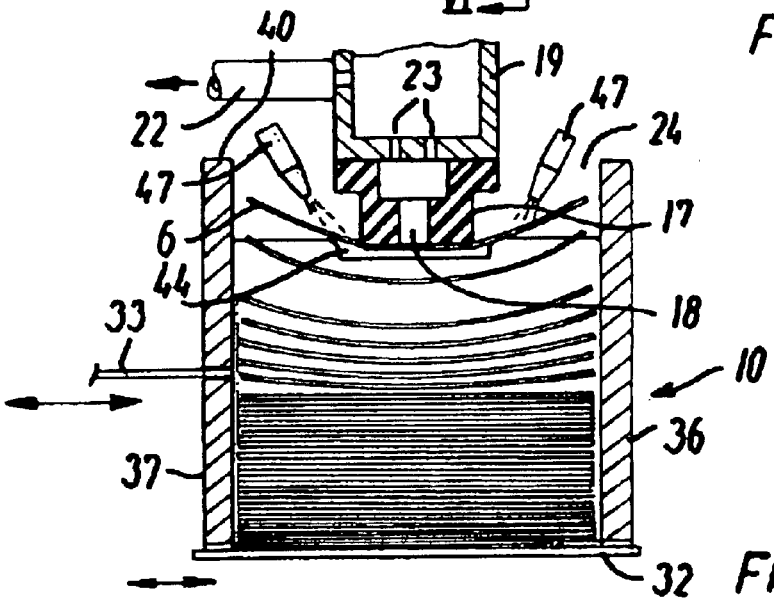
FIG. 6 is a sectional view taken along the line VI—VI of FIG. 5.

A number of projecting suction shoes 17 having suction holes 18 extending from the inside of the conveyor belt 12 to the lower face of the suction shoes are made at a mutual spacing on the conveyor belt which is also shown on a larger scale in FIGS. 4, 5 and 6.

A longitudinal suction box 19 extending from a first end 20 at the idler pulleys 15 and 16 to a second end 21 in an area above the stacking chute 10 is mounted in the belt conveyor 11. The suction box is connected to a vacuum source (not shown) via a fractionally shown vacuum channel 22.

During operation the lower run 13 of the conveyor belt is running along the lower face of the suction box whereas the upper run of the conveyor belt is running along its top face in the case shown.

Two rows of apertures or slits 23 are made in the lower face of the suction box and are displaced in relation to each other so that there will always be at least one aperture or slit 23 which is communicating with the suction hole 18 in an underlying suction shoe 17.

When the plant is in operation, the labels 6 are die-cut, as mentioned above, successively from the continuous label web 2. The die-cut labels are pushed one by one out onto the doctor blade 7 to a position in which they can immediately be sucked onto a suction shoe 17 on the lower run 13 of the conveyor belt 12 under the influence of the vacuum which is transmitted from the suction box 19 to the label 6 via the suction hole 18 of the suction shoe 17 and the apertures or slits 23 in the lower face of the suction box 19. The stuck labels 6 are conveyed in succession over the upper opening 24 of the stacking chute 10.

The negative pressure which thus is securing each label on a suction shoe will cease to exist as soon as the suction shoe has passed the second end 21 of the suction box 19 in the area above the upper opening 24 of the stacking chute 10 as the suction hole 18 of the suction shoe 17 is now communicating with open air instead. Thereby, the suction shoe lets go of the label which now falls down into the stacking chute.

The suction shoes 17 are preferably placed with a mutual spacing which is slightly greater than the extent of the labels in the longitudinal direction, and the rate of the conveyor belt is furthermore higher than the production rate of the rotary die cutter.

Thereby, the labels are kept at a distance from each other during the conveyance to the stacking chute, and they are therefore not charged with static electricity by accident by happening to slide over each other.

The driving pulleys 14 are driven by a motor 25 and the rotary die cutter 3 by a second motor 26. A servo-control 27 connected to the two motors 25 and 26 ensures that the relation between the production rate of the rotary die cutter and the rate of advance of the conveyor belt is kept at a constant value even if the rates are changed in order to e.g. be able to increase production.

When the labels thus are kept without accidental static electricity, they can be conveyed and stacked in orderly and accurate stacks in the stacking chute at very high rates.

In a preferred embodiment the labels are however charged with static electricity in a controlled manner in order to thereby increase the stacking rate further and obtain that the labels are bound together in a closely and firmly coherent stack.

This charging can take place in different ways. For example by blowing ionized air down over the top side of the labels that are guided in over the stacking chute.

In the example shown, the charging however takes place by means of a bar-shaped electrode 28 extending transversely to the direction of advance and in under the label that is immediately in front of the stacking chute at a given moment. The electrode is connected to a high-voltage generator 29 for impressing the electrode with the required high voltage.

When the rollers of the rotary die cutter are earthed, the potential on both sides of the die-cut labels will be zero, and this neutral potential will not change, as described above, during the subsequent conveying on the conveyor belt.

But when the labels are passing over the bar-shaped electrode 28, their underside is charged with static electricity whereas the top side still has a neutral potential.

Immediately after a label has passed the electrode and has reached over the upper opening of the stacking chute, it is released from the conveyor belt and falls down over the previous label in the stacking chute.

The top and under sides of the labels falling down the stacking chute at a given moment have different polarities. Each label will therefore try to pull the overlying label down with it in the stacking chute. On the way the distance between the two labels is reduced resulting in a simultaneous increase of the acting attractive forces.

Said attractive forces have a downward resultant ensuring a quick stacking of the labels in the stacking chute. When the labels are stacked, the attractive forces furthermore ensure that the labels are bound together into a closely and firmly coherent stack.

Labels are generally relatively thin and flexible. In some cases, it can be an advantage to have each label carried by more than suction shoe. In the variant of a conveyor belt 30 fractionally shown in FIG. 3, each label 6 is thus carried by two suction shoes 31.

In a second variant (not shown), the conveyor belt is provided with many closely spaced suction shoes. During the passage of the conveyor belt of a label on the doctor blade, there will therefore always be at least one suction shoe which will be in a position in which it can suck the label onto it.

When the labels are relatively wide, there can furthermore be placed two or more parallel conveyor belts (not shown) for supporting the labels.

In principle, the stacking chute 10 is merely a vertically placed tube having inside faces that are arranged as guides to the label stack.

During stacking in the stacking chute, the label stack is supported by a lower slide gate 32. When the stack has reached the desired height, an upper slide gate 33 is slid in over the stack via a slit (not shown) in the wall of the stacking chute while the lower slide gate 32 is drawn free of the stacking chute. Then, the stack falls down onto an underlying conveyor belt 34 which in the meantime has been raised to a level close to the stacking chute.

During this the upper slide gate 33 catches the labels that continue to fall down into the stacking chute. When the label stack is free of the stacking chute, the lower slide gate 32 is again pushed into position while the upper slide gate is drawn free of the stacking chute so that the lower gate 32 reassumes the supporting of the label stack.

At the same time the underlying conveyor belt 34 is lowered and then conveys the finished label stack 35 in the direction of the arrow for packaging, storing or dispatch.

FIGS. 4, 5 and 6 show an especially advantageous embodiment of a stacking chute according to the invention. In this case, the stacking chute is designed for rectangular labels but the principle shown can be utilized for labels of any other kind of contour within the scope of the invention.

Seen in the direction of conveyance of the labels, the stacking chute has a left side wall 36, a right side wall 37, a front wall 38, and a back wall 39. The inside faces of the walls form guides to the label stack and the label being stacked. The back wall 39 is higher than the front wall 38, and the top faces of the walls 40 are inclining downwards from the higher back wall 39 to the lower front wall 38 and continue in an inclined inlet face 41 on a ramp 42.

The front edge 43 of the inlet face is situated at a lower level than the feed level of the labels while the top side of the front wall 38 is situated a little higher than this level.

A front horizontal channel 44 is preferably made centrally in the ramp 42 and the front wall 38, and a back horizontal channel 45 is made in the back wall and is flush with the front channel. Both channels have a depth and width that allow the conveyor belt 12 but not the label 6 in their full width to pass.

During conveying, a label will meet the inclined inlet face 41 of the ramp 42 first as the front edge 43 of this face is situated at a lower level than the feed level of the labels.

Then, the chief part of the label is guided further up the inclined inlet face and partly up the inclined top sides 40 of the walls while the central part of the label which is retained by a suction shoe 17 is drawn through the front channel 44.

Thereby, the label is bent, as shown in FIG. 6, so that the distance between its side edges will be smaller than the distance between the inside faces of the side walls 36 and 37 of the stacking chute.

When the suction shoe lets go of the label in the area above the upper opening 24 of the stacking chute, it is freely allowed to fall down into the stacking chute without being inclined to, as in the case of a plane label, be caught between the side walls of the chute.

From an aerodynamic point of view, the bent shape of the label is advantageous and causes the labels to be able to fall down through the air in the stacking chute with less flow resistance and therefore more quickly than if the label had maintained its plane shape.

During the fall, the displaced air will flow up along the underside of the bent label and further into the open air via the spaces between the side edges of the labels and the inside faces of the walls.

The suction shoe lets go of the label as soon as this label has passed the second end 21 of the longitudinal suction box 19, which second end is situated close to the back wall 39 in the area above the upper opening 24 of the stacking chute.

The conveyor belt 12 conveys the suction shoe 17 out of the stacking chute immediately after via the back channel 45 in the back wall 39 while the now released label 6 is stopped by the inside face of the back wall. Thereby, the labels are ensured a precise positioning in the stacking chute and a carefully arranged label stack of precisely flushing labels is formed.

As shown in FIG. 4, vertical channels 46 are furthermore made in the stacking chute for evacuating displaced air during stacking. For this same purpose, side openings (not shown) can furthermore be made in the walls of the stacking chute.

Alternatively, the walls can merely consist of wires or rods placed equidistantly.

As shown in FIGS. 4 and 6, air nozzles 47 are furthermore placed above the upper opening 24 of the stacking chute for blowing air down over the topmost label in the stacking chute. The purpose of the air pressure is to force the topmost label and thereby also the underlying labels quickly down in the stacking chute.

The air currents can advantageously be ionized in order to thereby, as mentioned above, be able to charge the labels with static electricity in a controlled manner.

By means of the label stacker according to the invention labels can now be stacked at the same rate as a rotary die cutter is able to die-cut the labels, i.e. at a rate of e.g. 300 m/min or more.

Thereby, the capacity of the rotary die cutter can be utilized completely.

Figure 7:
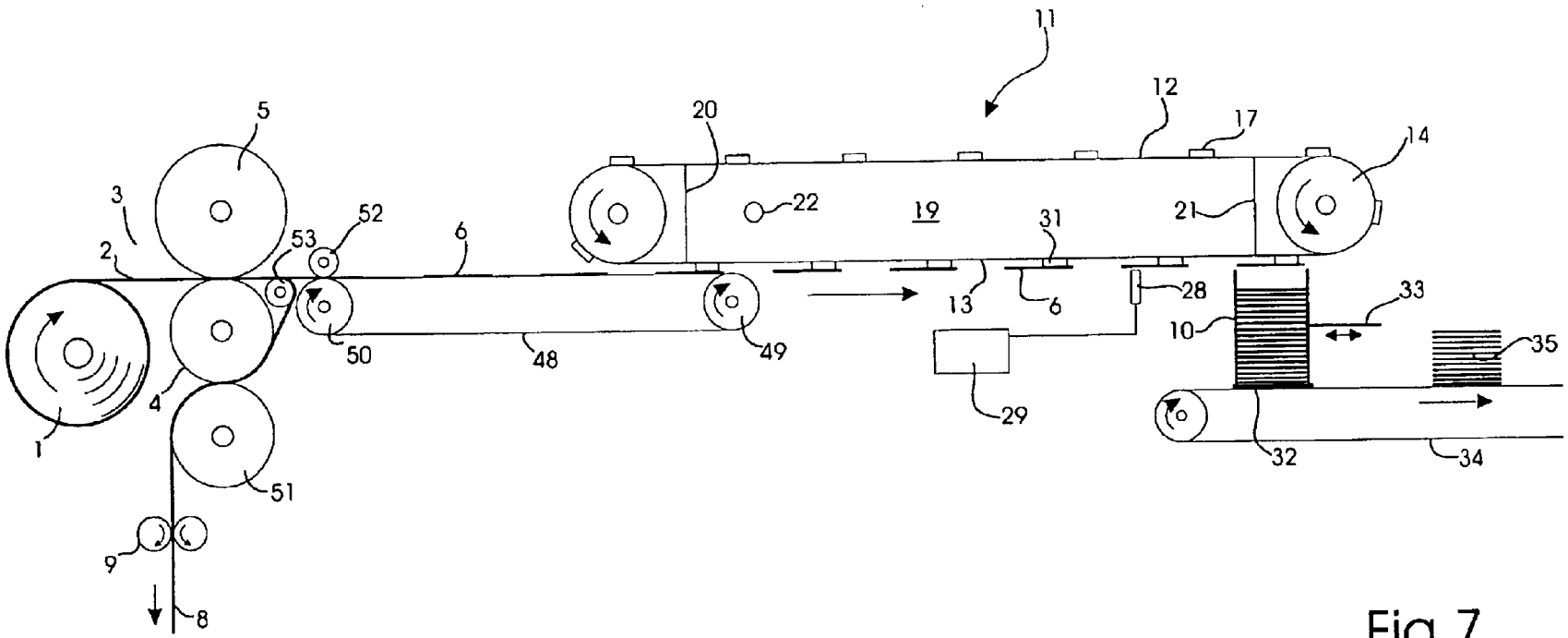
FIG. 7 is a diagrammatic side elevational view of a second embodiment of a plant for die-cutting products from a continuous product web and comprising a stacker according to the invention with a conveyor belt and a stacking chute.

FIG. 7 shows a second embodiment of a plant for die-cutting and stacking labels. This plant corresponds essentially to the one shown in FIGS. 1–6 and described above. Thus, like parts are similarly referenced.

In this case, an underlying belt conveyor 48 with a driving pulley 49 and an idler pulley 50 is inserted between the die cutter 3 and the overlying belt conveyor 11. The impression roller 4 is furthermore supported by a supporting roller 51.

An upper, roller-shaped, rotatable electrode 52 is mounted above the continuous label web 2 in the area at the idler roller 50 and a lower, roller-shaped, rotatable electrode 53 is mounted under the web 2. Both electrodes, which for example can be made of carbon, are earthed and contact the continuous label web 2 which therefore is discharged of possible static electricity which might make the subsequent stacking of the labels in the stacking chute 10 difficult.

As shown, the die-cut scrap 8 runs about the lower electrode 53 which furthermore has a relatively small diameter whereby the die-cut labels 6 and the die-cut scrap 8 can be separated from each other easily and effectively.

After having passed the lower electrode 53, the die-cut scrap 8 is guided around the supporting roller 51 and through the counter-rotating scrap rollers 9 which convey the die-cut scrap 8 in downward direction.

In some cases, the spacing between the suction holes in the conveyor belt can have a size corresponding to the length of a specific label plus waste plus an adequate spacing between the labels on the conveyor belt.

Thereby, the rate of the conveyor belt will mainly correspond to the production rate of the rotary die cutter. If the hole spacing is different, the rate of conveyance however has to be changed correspondingly.

The dependency can be expressed by formula (1):

$$Vt=k\times a/l,$$

where a is the mutual spacing between a row of related suction holes, l is the length of a die-cut product or of a die-cut product plus waste, and k is a constant.

Alternatively, this dependency can be expressed by formula (2):

$$Vt=1/l+\delta a,$$

where a is the mutual spacing between a row of related suction holes, l is the length of a die-cut product or a die-cut product plus waste, and δa is a determined spacing between two die-cut products.

If formula (1) is utilized, the spacing between two consecutive labels on the conveyor belt will depend on the relation between the mutual spacing between the suction holes and the length of the respective label. If formula (2) is utilized, a fixed spacing will be obtained.

In the terminal phase in which the conveyor belt lets go of the label, this label is thrown in against the back wall 39 of the stacking box 10 with a force that depends on the rate of conveyance. If this rate is too high, there is a risk that the edge of the label is damaged and that the label furthermore cannot be placed in the stacking chute with satisfactory accuracy.

It has proven that the stacking can be done without these disadvantages when the rate of conveyance Vt of the conveyor belt in percentage of the production rate Vp of the die cutter is in the following intervals: 100% to 600%, preferably 100% to 400% and especially 100% to 200%.

Another factor that has an influence on the force with which the label is thrown in against the back wall of the stacking box is the distance which the released label has to travel in the terminal phase before it hits the wall. If this distance is too short, the result could be the above disadvantages. If the distance is too great, it could be difficult for the label to be caught correctly by the stacking chute.

Therefore, the stacking chute is arranged to be adjustable in distance from the die cutter. Thereby, the distance from the just released label to the back wall of the stacking chute can be adjusted in dependence on the rate of conveyance in such a way that the force with which the label hits the back wall of the stacking chute will be the least possible at the same time as the labels can be stacked in the stacking chute with proper accuracy and precision.

In principle, the stacker can function with very few suction holes which consequently are made with a relatively great mutual spacing in the conveyor belt. However, the formulas (1) or (2) indicate that the rate of conveyance Vt then must be correspondingly high so that it can be difficult to respect the limitations set by the intervals (3). This is especially the case for relatively short labels whereas relatively long labels allow application of suction holes having greater mutual spacing.

However, a label plant is usually intended for use in manufacture and stacking of both short and long labels. In this case in order to be able to simultaneously meet the criteria in the formulas (1) or (2) and the intervals (3), the conveyor belt must necessarily be divided with suction holes that can form hole rows with hole spacings that fit the respective label lengths. Preferably the division takes place in such a way that as many as possible of the holes are joint to the different rows.

In practice, the hole spacing a and the rate of conveyance Vt are chosen so that they fit the formulas (1) or (2) and the intervals (3).

FIG. 9 is an example showing diagrammatically how a conveyor belt having a length of 2100 mm is made with suction holes that can form nine different rows whereby the stacker can convey and stack labels of lengths ranging from very short labels of 1⅝ inches to very long labels of 17 inches within the speed restrictions indicated in the intervals (3).

In the diagram, it is for example shown that hole row 1 only makes use of four suction holes with great mutual spacing, namely 525 mm. This row is intended for very long labels of between 15 and 17 inches. The rate of conveyance is advantageously within the limitation of the intervals (3) or more specific, between 122% and 138% of the production rate.

To the contrary, hole row 9 in the opposite end of the scale is intended for very short labels, namely labels as short as 1⅝–2⅝ inches. The row has 30 suction holes with a mutual spacing of 70 mm. Also in this case, the rate of conveyance is advantageously within the limitation of the intervals (3) or more specifically between 122% and 184% of the production rate.

As shown, the rest of the hole rows correspondingly utilize suction holes which in number and mutual spacing fit a certain length interval at the same time as the rate of conveyance advantageously is kept within the limitation of the intervals (3).

When a label of a certain length is to be conveyed to the suction chute 10, the suction holes that exactly fit this length are chosen whereas the rest of the holes are closed by e.g. plugs. Then, the labels can, as wanted, be stuck to the suction holes which in a given case have been chosen for labels of this length.

Instead of utilizing a conveyor belt which is divided with suction holes that can be utilized for labels of different lengths by closing the holes that are not utilized for a certain label, a conveyor belt having suction holes only fitting labels within one length interval can alternatively be utilized.

The invention is described on the assumption that it is labels that are to be stacked. Naturally, this is only to be taken as an example as the invention can be utilized for stacking any other kind of product that is die-cut from a continuous product web, for example ostomy plates or die-cuttings that are subsequently folded into boxes.

What is claimed is:

1. A stacker for stacking products that are die-cut from a continuous web by a die cutter into vertical stacks, comprising:

at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, a suction box located above the lower run and connected to a vacuum source communicating with the suction holes of the lower run of the belt via the suction box in an area around the die cutter but not in an area around the stacking chute, and a channel for receiving at least a lower part of the lower run of the conveyor belt provided in at least the front wall of the stacking chute, with the channel extending in the conveying direction, wherein the products are bent as they pass over the channel in the front wall of the stacking chute to assist in stacking the labels in the at least one stacking chute.

2. The stacker according to claim 1, wherein the channel can accommodate the entire lower run of the conveyor belt and is provided in both the front and back walls of the stacking chute, with the back wall acting as a stop to movement of the conveyed products.

3. The stacker according to claim 1, wherein the stacking chute walls provide a top opening for the chute that inclines downwardly from the back wall to the front wall, with the top opening continuing into an inclined inlet face or shelf that extends beneath the lower run of the conveyor belt.

4. The stacker according to claim 1, further comprising apertures in the walls of the stacking chute to allow air to exit the chute.

5. A stacker for stacking products that are die-cut from a continuous web by a die cutter into vertical stacks, comprising:

at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, a suction box located above the lower run and connected to a vacuum source communicating with the suction holes of the lower run of the belt via the suction box in an area around the die cutter but not in an area around the stacking chute, and a channel for receiving at least a lower part of the lower run of the conveyor belt provided in at least the front wall of the stacking chute, with the channel extending in the conveying direction, wherein the rate of conveyance (Vt) of the conveyor belt is chosen among values meeting the formula $$Vt=k\times a/l$$

where a is the mutual spacing between a row of related suction holes, l is the length of a die-cut product or a die-cut product plus waste, and k is a constant.

6. A stacker for stacking products that are die-cut from a continuous web by a die cutter into vertical stacks, comprising:

at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, a suction box located above the lower run and connected to a vacuum source communicating with the suction holes of the lower run of the belt via the suction box in an area around the die cutter but not in an area around the stacking chute and a channel for receiving at least a lower part of the lower run of the conveyor belt provided in at least the front wall of the stacking chute, with the channel extending in the conveying direction, wherein the rate of conveyance (Vt) of the conveyor belt is chosen among values meeting the formula $$Vt=a/l+\delta a$$

where a is the mutual spacing between a row of related suction holes, l is the length of a die-cut product or a die-cut product plus waste, and δa is a determined spacing between two die-cut products.

7. The stacker according to claim 1, wherein the conveyor belt has a rate of conveyance (Vt) which is between 100% and 600% of the production rate (Vp) of the die cutter.

8. The stacker according to claim 1, wherein the conveyor belt has a rate of conveyance (Vt) which is between 100% and 400% of the production rate (Vp) of the die cutter.

9. The stacker according to claim 1, wherein the conveyor belt includes several rows of suction holes.

10. The stacker according to claim 9, wherein the conveyor belt has a length which is a whole multiple (n) of the spacing (a) between the suction holes in each of the row of suction holes made in the conveyor belt.

11. The stacker according to claim 1, wherein a suction shoe is provided around each suction hole of the conveyor belt, with this suction shoe extending outwardly from the belt.

12. The stacker according to claim 1, wherein the stacking chute is placed at a distance from the die cutter that is adjustable.

13. The stacker according to claim 1, wherein the stacker comprises a servo-control for controlling the rate of conveyance of the belt conveyor depending upon die cutter production rates.

14. A stacker for stacking products that are die-cut from a continuous web by a die cutter into vertical stacks, comprising:

at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, a suction box located above the lower run and connected to a vacuum source communicating with the suction holes of the lower run of the belt via the suction box in an area around the die cutter but not in an area around the stacking chute, a channel for receiving at least a lower part of the lower run of the conveyor belt provided in at least the front wall of the stacking chute, with the channel extending in the conveying direction, and at least one roller-shaped, rotatable electrode disposed at the die cutter in contact with the continuous web from which the products are die-cut.

15. A stacker for stacking products that are die-cut from a continuous web by a die cutter into vertical stacks, comprising:

at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, a suction box located above the lower run and connected to a vacuum source communicating with the suction holes of the lower run of the belt via the suction box in an area around the die cutter but not in an area around the stacking chute, and a channel for receiving at least a lower part of the lower run of the conveyor belt provided in at least the front wall of the stacking chute, with the channel extending in the conveying direction, wherein the die cutter is a rotary die cutter with an overlying die-cutting roller and an underlying impression roller, wherein a roller-shaped, rotatable electrode is disposed close to the impression roller in contact with the underside of the continuous web from which the products are die-cut, and wherein die-cut scrap is guided around the electrode in downward direction.

16. A stacker for stacking products that are die-cut from a continuous web by a die cutter into vertical stacks, comprising:

at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, a suction box located above the lower run and connected to a vacuum source communicating with the suction holes of the lower run of the belt via the suction box in an area around the die cutter but not in an area around the stacking chute, a channel for receiving at least a lower part of the lower run of the conveyor belt provided in at least the front wall of the stacking chute, with the channel extending in the conveying direction; and means for charging the products electrostatically prior to or during stacking so that opposite sides of each product to be stacked obtains different polarities, and that like polarized sides on each product faces the same direction.

17. A stacker for stacking products that are die-cut from a continuous web by a die cutter into vertical stacks, comprising:

at least one stacking chute having an upper opening and at least front and back vertically arranged walls, at least one overlying belt conveyor that includes a conveyor belt having a number of suction holes distributed along the belt, and a lower run with a direction of conveyance running from the die cutter to the stacking chute, with the front wall of the stacking chute being arranged as the first wall to be encountered by the lower run of the belt in the direction of conveyance, wherein the products are bent as they pass over the channel in the front wall of the stacking chute to assist in stacking the labels in the at least one stacking chute, and a suction box located above the lower run and connected to a vacuum source communicating with the suction holes of the lower run of the belt via the suction box in an area around the die cutter but not in an area around the stacking chute, wherein the stacking chute walls provide a top opening for the chute that inclines downwardly from the back wall to the front wall, with the top opening continuing into an inclined inlet face or shelf that extends beneath the lower run of the conveyor belt.

18. A method for stacking labels which comprises bending the labels as they pass over the front wall of a stacking chute to assist in stacking the labels in the chute.

19. A method for stacking labels using the stacker of claim 1 to bend the labels as they pass over the channel in the front wall of the stacking chute to assist in stacking the labels in the chute.

20. A method for stacking labels using the stacker of claim 17 to bend the labels as they pass over the channel in the front wall of the stacking chute to assist in stacking the labels in the chute.

* * * * *